US005199139A

United States Patent [19]

Hutchinson

[11] Patent Number: 5,199,139

[45] Date of Patent: Apr. 6, 1993

[54] FASTENING DEVICE

[76] Inventor: T. Gordon Hutchinson, P.O. Box 250, Dublin, N.H. 03444

[21] Appl. No.: 837,739

[22] Filed: Feb. 19, 1992

Related U.S. Application Data

[63] Continuation-in-part of Ser. No. 734,214, Jul. 22, 1991, Pat. No. 5,129,926, which is a continuation-in-part of Ser. No. 584,196, Sep. 18, 1990, Pat. No. 5,075,938, which is a continuation-in-part of Ser. No. D. 535,872, Jun. 11, 1990.

[51] Int. Cl.[5] ..... A44B 17/00

[52] U.S. Cl. ..... 24/464; 24/108; 24/470

[58] Field of Search ..... 24/464, 108, 470, 473, 24/476, 477, 453, 297, 465, 466, 467, 468, 469

[56] References Cited

U.S. PATENT DOCUMENTS

| | | | |
|---|---|---|---|
| 487,344 | 12/1892 | Capewell | 24/108 |
| 781,430 | 1/1905 | Kellogg | 24/470 |
| 1,076,675 | 10/1913 | Jennings | 24/470 |
| 1,403,802 | 1/1922 | Mayr | 24/108 |
| 1,442,475 | 1/1923 | Jay | 24/470 |
| 1,570,625 | 1/1926 | Eddins | 24/464 |
| 2,937,834 | 5/1960 | Orenick et al. | 24/464 |
| 3,530,550 | 9/1970 | White | 24/464 |
| 3,644,965 | 2/1972 | Kahn | 24/108 |
| 4,291,698 | 9/1981 | Fuchs et al. | 24/464 |
| 5,075,938 | 12/1991 | Hutchinson | 24/464 |

FOREIGN PATENT DOCUMENTS

| | | | |
|---|---|---|---|
| 0943699 | 12/1963 | United Kingdom | 24/464 |

*Primary Examiner*—Victor N. Sakran
*Attorney, Agent, or Firm*—George W. Dishong

[57] ABSTRACT

A fastening device or apparatus wherein mechanical connection and/or disconnection or electrical connection and/or disconnection is accomplished as a result of the deformation of an oval/ellipse shaped component—the deformable component—which may preferably have an elliptical aperture therethrough. Deformation may result from the application of a deforming force which causes the decrease in length of the major axis and a consequent increase in length of the minor axis of the ellipse. The deforming force may be applied by any known means such as by magnetic fields applied where the deformable component may have incorporated therein material which is sensitive and reactive to such magnetic fields or by the application of mechanical pressure from a piston driven by magnetic forces or hydraulic forces and/or forces created by temperature changes such as are known and found in a class of materials characterized as "SHAPE MEMORY ALLOYS". Thus the fastening device may be designed so that the forces causing deformation may be applied interior to the deformable component thereby permitting the pegs and/or holes to be located on the outer peripheral surface of the deformable component. Such a deformable component can cooperate with a non-circular cooperating component which is quite different from the substantially cylindrical/circular construction of the stud/-male component which is insertable into the elliptical shaped aperture. The peg-and-hole combination being arranged as a part of the respective component so that there is a mating relationship between them when mechanical attachment or an electrical connection is to be achieved. The deforming force, no matter how it is generated is applied in such a manner so that the piston device physically and appropriately pushes or pulls on the deformable component in either the direction of the major or minor axis. Force from manual squeezing of the deformable component along the direction of the major axis may also be applied to cause the deformation and the subsequent connection or disconnection of the stud or cooperating components. More particularly, the invention is very simply based upon the deformation by any known means of force generation of an oval or elliptically cross-sectioned aperture and/or elliptical periphery which results in forces, due to the deformation and due to the characteristics of the material which cause the two components to interengage and the interengagement can be caused to be made or released by the application of the deforming force.

20 Claims, 4 Drawing Sheets

FASTENING DEVICE

BACKGROUND OF THE INVENTION

1. Related Application

This application is a continuation-in-part of copending application Ser. No. 734,214, filed Jul. 22, 1991 now U.S. Pat. No. 5,129,926 which is a continuation-in-part of copending application Ser. No. 584,196, filed Sep. 18, 1990 now U.S. Pat. No. 5,075,938 which is a continuation-in-part of copending Design patent application Ser. No. 535,872, filed on Jun. 11, 1990, the disclosures of which are hereby incorporated by reference.

2. Field of the Invention

This invention most generally relates to a two part device to fasten together, for example; a plurality of sheets of material, such as for example paper, which may have but need not have previously made holes in them; a plurality of strands of wire such as is fastened or cabled by straps used in the making of wiring harnesses; connecting tubing together in a manner which allows for easy connection and release by simply a one-handed squeezing operation or otherwise providing a deformation force which has the same effect as manual squeezing; and/or locating of sheets vertically positioned on a stud or a number of studs and holding the sheets (such as printed circuit boards) in relative vertical positions; and/or providing for the convenient connection and disconnection of two dissimilar articles such as for example a safety razor handle and safety razor blade.

The device may be composed of plastic, metal or other material which is resilient but form retaining or which is deforms as a consequence of the application of a deforming force. The concept used to provide the snap fastening or simply the fastening feature is the deformation of an ellipse or oval into a circle. In copending applications, the deformation of the ellipse takes place when the stud/male component of the fastener is pressed into the socket/female component and attachment results due to the tendency of the material to return the shape of the socket component. The closing of the fastener causes the deformation of the ellipse/oval into an approximate circle and the stresses created provide the forces necessary to keep the fastener securely together providing the means for holding together the articles being attached to each other such as for example papers, items of fabric, shoe-top parts, articles of clothing such as gowns etc. It is further noted that in the copending applications for patent, the stud and socket components may be adapted to have a plurality of interengagement discs on the stud component and at least one recess within the aperture of the socket component which recess cooperates with one of the discs of the stud component to result in the interengagement of the two components when the stud component is inserted into the socket component aperture. Where there is more than one recess in the aperture of the socket component each of the recesses may interengage with one of the discs of the stud component. The resulting interengagement will be adjustable in that the stud portion will be more or less into the aperture and as the number of disc/recess interengagements increases so do the security of the connection of the two components increase. There may also be two "stud components" which may be connected together end-to-end using a socket component adapted to interengage with each of the two stud components. The end-to-end interengagement may be made and released by the one hand deformation of the socket component—that is the changing of the aperture from ellipse to oval by squeezing parallel to the major axis and then releasing allowing the aperture to tend toward an elliptical shape which results in the engagement of the two stud components. Release is accomplished by simply squeezing along the major axis causing deformation of the aperture to the circular/oval cross section allowing the disengagement of the stud components.

There is disclosed herein still other useful and unobvious variation of the invention disclosed in my copending patent applications—the fundamental use of the mechanism of the deformation of an elliptically shaped socket/female/deformable component and/or an aperture therethrough from being elliptical toward being circular is to provide the means for connecting and holding in relative relationship similar or dissimilar articles.

The deformable component (that component which undergoes, from externally provided forces such as squeezing by a persons fingers or through the use of a tool or through the use of electrically or magnetically generated forces, and/or forces created by temperature changes such as are known and found in a class of materials characterized as "SHAPE MEMORY ALLOYS") may be designed to cooperate with a non-circular stud/male/cooperating component which is quite different from the substantially cylindrical/circular construction of the stud/male component as defined and described in copending applications. The peg or hole, may be located on the outer peripheral surface of the socket/female component and as a consequence, the female component, now more appropriately called the deformable component, may engage with the stud component, now more appropriately called the cooperating component, as a result of the mating of a peg with an aperture/hole either the peg or the hole being a part of the deformable component and correspondingly the hole or the peg being a part of the cooperating component. The peg-and-hole combination being arranged as a part of the respective component so that there is a mating relationship between them when attachment is to be achieved. Again, because the peg, for example, may be located along the minor axis and on the outer periphery of the deformable component, connection can be made with another component—the cooperating component—which now need not be circular and cylindrical in shape because it is not being placed within the elliptical aperture of the deformable component. Instead of engagement taking place in a ridge or edge as in the copending applications, engagement results from the mating of peg and hole.

Because of the use of the deformation of the axes of the elliptical shaped component, that is under the same forces the major axis shortens and the minor axis lengthens, many types of fastening or attaching combinations may be achieved. Taking as an example the placing of a peg or two (2) directed parallel to and in-line with the major axis and extending radially from the outside facing edge or surfaces of the deformable elliptically shaped component. With the application of a force which results in the shortening of the length of the major axis and a consequent lengthening of the minor axis, a connection will be released if the peg or pegs were previously engaged or connected to a mating hole of the cooperating component. The cooperating component could, for example, be a basket having the mating hole horizontally opposed along an axis and located on the basket perimeter. The deformable component would be normally engaged if the pegs were position on the outer periphery and at the ends of the major axis of the elliptical shaped component and the application of the deforming force then causes the basket to release.

The deformable component is characterized by having a substantially elliptically shape and/or having an elliptical shaped aperture therethrough and including means for engaging or interengaging a stud or cooperating component when the two components are placed in mating relationship. The connecting or disconnecting of the two components is effected by application of a force along the major axis of the ellipse which shortens the length of the major axis and increases the length of the minor axis.

DESCRIPTION OF THE PRIOR ART

Presently there is nothing available that permits the attachment of two components and the release of such attached components both steps being achievable using the squeezing or pinching forces on only the periphery of a so called deformable component and exertable with the use of one hand; more specifically the use of the fingers of one hand. The invention disclosed herein is based upon the deformation by a substantially cylindrical shaped member of an oval or elliptically cross-sectioned aperture which results in forces, due to the deformation and due to the characteristics of the material in which the aperture in located, which cause two components, a stud or cooperating component and a deformable component, to interengage and the interengagement can be caused to be released by the simple squeezing or pinching of only the deformable component using the fingers of one hand. In contrast, the prior art devices require pressure in the direction which is opposite to the direction of the insertion force and very importantly they require access to both components used in the clamping system. The fastener of the instant invention can thus be engaged and disengaged having access to only the deformable component.

The following U.S. Patents have been reviewed relative to the invention disclosed and claimed herein.

U.S. Pat. No. 3,530,550 to White discloses a clamp composed of mating discs for engaging pliant sheet material, such as for fastening baby diapers without the use of pins or the like, and interengaging members provided on the discs for holding them together until released by pressure. An interconnecting flexible strap holds the discs together when they are not in clamping engagement. The opposed mating discs are frictionally held together when in clamping position and released by finger and thumb pressure of the user in a direction along the aperture axis. White relies on the material characteristics to provide the means for disengagement of 22 from 26.

U.S. Pat. No. 4,825,516 to Ackermann et al, teaches a snap-fastener comprising stud and socket components. This invention teaches the notion of placing a pliant substrate of material in such a position so that when the stud and socket components are closed they "pinch" the material therebetween.

The U.S. Pat. Nos. 3,626,955 to Greenwood; 1,276,030 to Adler; 3,039,471 to Church; 2,583,224 to McDonald; and 2,590,175 to Hajdu were also reviewed.

The present invention as disclosed and claimed herein has clear and unobvious advantages over all of the prior art known to the Applicant.

SUMMARY OF THE INVENTION

The present invention in it's most simple form or embodiment is directed to a fastening device or apparatus wherein connection and/or disconnection is accomplished as a result of the deformation of an oval/ellipse shaped component—the deformable component—which may preferably have an elliptical aperture therethrough. Deformation may result from the application of a deforming force which causes the decrease in length of the major axis and a consequent increase in length of the minor axis of the ellipse. The deforming force may be applied by any known means such as by magnetic fields applied where the deformable component may have incorporated therein material which is sensitive and reactive to such magnetic fields or by the application of mechanical pressure from a piston driven by magnetic forces or hydraulic forces in such a manner so that the piston device physically and appropriately pushes or pulls on the deformable component in either the direction of the major or minor axis. Force from manual squeezing of the deformable component along the direction of the major axis may also be applied to cause the deformation and the subsequent connection or disconnection of the stud or cooperating components.

The means for engaging with the stud or cooperating components may be matingly positioned or located on the interior surface which surface defines the aperture of the deformable component or on the outer peripheral surface. In both embodiments, the means for engaging lie along either the major axis and/or the minor axis of the elliptically shaped deformable component and preferably are directed parallel into or out of the surface. It should be noted however that for example, where the means for engaging comprise a peg and a hole into which the peg mates the direction may be other than radial to the surface or parallel and in-line with the axes. The consequence of such an arrangement is that there would be required a rotation and/or a translational movement of one of the cooperating components in order to affect a connect or a disconnect which movement would be additional to the deformation of the deformable component.

The present invention permits the attachment of two components and the release of such attached components both steps being achievable using the squeezing or pinching forces on only the periphery of a so called deformable component and exertable with the use of one hand; more specifically the use of the fingers of one hand. More particularly, the invention disclosed herein is very simply based upon the deformation by a substantially cylindrical shaped member or an oval or elliptically cross-sectioned aperture which results in forces, due to the deformation and due to the characteristics of the material in which the aperture in located, which cause two components, a stud or cooperating component and a socket/deformable component, to interengage and the interengagement can be caused to be released by the simple squeezing or pinching of only the deformable component using the fingers of one hand. The components may be adapted to have a plurality of means for interengagement such as pegs or holes on the stud or cooperating component and at least one pair of holes or, corresponding to the holes of the cooperating component, at least one pair of pegs on the minor axis and/or the major axis and within the aperture of the deformable component which pair of holes or pegs cooperates with at least one of the pegs or holes on the stud or cooperating component to result in the interengagement of the two components when the stud component is inserted into the deformable component aperture. Where there is more than one pair of holes or pegs in the aperture of the deformable component each of them may interengage with one of the pegs or holes on the stud or cooperating component. The resulting interengagement will be adjustable in that the stud portion will be more or less into the aperture and as the number of peg/hole interengagements increases so does the security of the connection of the two components increase. There may also be two "stud components" which may be connected together end-to-end using a deformable component adapted to interengage with each of the two stud components. The end-to-end interengagement may be made and released by the one hand deformation of the deformable component—that is the changing of the aperture from ellipse to oval by squeezing parallel to the major axis and then releasing allowing the aperture to tend toward an elliptical shape which results in the engagement of the two stud components. Release is accomplished by simply squeezing along the major axis causing deformation of the aperture to the circular/oval cross section allowing the disengagement of the stud components. The fastener of the instant invention can thus be engaged and disengaged having physical access or access by a force applying means to only the deformable component.

An object of the invention is to provide a fastening device comprising: a stud component; a deformable component having a dimensionally deformable substantially elliptical shaped aperture therein. The deformable component aperture has a major axis dimension and a minor axis dimension, the major axis dimension being greater than the minor axis dimenion. The aperture is adapted to receive into interengaging position the stud component when the stud component is inserted into the aperture of the deformable component and when the deformable component is placed onto said stud component. There is also a means for deforming the aperture thereby creating a deforming force along a direction parallel to the major axis and perpendicular to the minor axis of the elliptical shaped aperture. The aperture axes dimensions are deformable so that the minor axis dimension increases as the major axis dimension decreases upon inserting and extracting of the stud component into and from the aperture of the deformable component and upon application of the deforming force to the deformable component. The stud component comprises a substantially cylindrical shaped stud member. The aperture to receive the stud component thereby puts the deformable component and the stud component into interengaging relationship when the stud member is inserted into the aperture or when the deformable component is placed onto the stud component. There is also at least one means for interengaging the deformable and the stud components which means are matingly positioned and located on an interior wall of the aperture of the deformable component and which lie parallel to and in line with a minor axis of the elliptically shaped aperture. The interengaging means is also integral with the stud member and adapted to matingly cooperate with the deformable component to interengage the stud and deformable components. And there is also provided interengagement forces created by the deformation of the aperture and the interengagement of the deformable component with the stud component when the stud component is in interengagement with the deformable component.

A particular object of the present invention is to provide the fastening device as described above wherein the deformable component is fabricated using material which is resilient but form retaining and the interengagement forces created by the deformation of the aperture are further created by the resilience of the material.

Another particular object of the present invention is to provide the fastening device as described above wherein the at least one pair of interengaging means comprises: at least one pair of mating holes or pegs disposed on opposite ends of radii of the stud member, integral with and distributed along the stud member between the body portion and a protruding end of the stud member and spacing between adjacent pairs or holes or pegs being not less than a dimension which is adequate to permit the interengaging of the stud and deformable components. The deformable component is adapted to have at least one pair of pegs or holes for engagement which matingly cooperates with at least one pair of the at least one pair of mating holes or pegs of the stud component when the stud component and the deformable component are attached as a consequence of application of the deforming force. The stud component and deformable component interengagement results from the interengagement forces created by the deformation of the aperture.

A more particular object of the present invention is to provide the fastening device as described above wherein the means for deforming the aperture comprises an appropriate mechanical deforming force resulting from the application of sufficient magnetic energy to cause the aperture deformation allowing the engagement and disengagement of the deformable component and the stud component. Further, there may be provided a means for flexibly connecting the stud component to the deformable component.

A still more particular object of the present invention is to provide the fastening device as described above wherein the deformable component is fabricated using shape memory alloys selected from the group consisting of nickel-titanium alloys and copper-base alloys Cu-Zn-Al and Cu-Al-Ni. The means for deforming the aperture comprises an appropriate means for application of sufficient thermal energy to the deformable component thus creating the deforming force sufficient in magnitude to cause the aperture deformation allowing the engagement and disengagement of the deformable component and the stud component.

A primary object of the present invention is to provide a fastening device comprising: a deformable component having a dimensionally deformable, substantially elliptical shaped outer periphery and preferably an aperture therethrough. The deformable component has a major axis dimension and a minor axis dimension, the major axis dimension being greater than the minor axis dimension. The deformable component is adapted to receive into interengaging position the cooperating component when the cooperating component and the deformable component are in an interengaging relationship. The means for deforming said elliptical shaped outer periphery thereby creating a deforming force along a direction parallel to the major axis and perpendicular to the minor axis, the axes dimensions deformable so that the minor axis dimension increases as the major axis dimension decreases upon application of the deforming force to the deformable component. There is also provided at least one means for interengaging the deformable and cooperating components. The at least one means for interengaging each is matingly positioned and located on an outer peripheral surface of the deformable component. The means for interengaging lie parallel to and in line with a minor axis of the elliptically shaped outer periphery or, in the instance where it is desired to have connection or engagement without the application of the deforming force, parallel to and in line with a major axis of the deformable component. The mating component of the interengaging means are integral with the cooperating member and adapted to matingly cooperate with the deformable component to interengage the cooperating and the deformable components. The interengagement forces may be partly created by the deformation of the deformable component but may also be provided by the mechanical externally applied force of a piston which piston pulls or pushes under the influence of magnetic fields or hydraulic forces. The interengagement of the deformable component with the cooperating component being only at at least one end of either the minor axis or major axis or in fact both axes when the cooperating component is in interengagement with the deformable component.

A particular primary object of the present invention is to provide the fastening device as described above wherein the deformable component is fabricated using material which is resilient but form retaining and the interengagement forces created by the deformation of the deformable component are further created by the resilience of the material.

Another particular primary object of the present invention is to provide the fastening device as described above wherein the at least one pair of interengaging means comprises: at least one pair of mating holes or pegs disposed on the cooperating member to permit the interengaging of the cooperating and the deformable component. The deformable component is adapted to have at least one pair of pegs or holes for engagement which matingly cooperates with at least one pair of the at least one pair of mating holes or pegs of the cooperating component when the cooperating component and the deformable component are attached as a consequence of application of the deforming force. The cooperating component and deformable component interegagement results from the interengagement forces created by the deformation of the deformable component.

Still another particular primary object of the present invention is to provide the fastening device as described above wherein the means for deforming the deformable component and particularly the outer periphery of same comprises an appropriate mechanical deforming force resulting from the application of sufficient magnetic energy to cause the deformation allowing the engagement and disengagement of the deformable component and the cooperating component.

Yet still another particular primary object of the present invention is to provide the fastening device as described above wherein said deformable component is fabricated using shape memory alloys selected from the group consisting of nickel-titanium alloys and copper-base alloys Cu-Zn-Al and Cu-Al-Ni and the means for deforming the periphery comprises an appropriate means for application of sufficient thermal energy to the deformable component thus creating the deforming force sufficient in magnitude to cause the periphery deformation allowing the engagement and disengagement of the deformable component and the cooperating component.

These and further objects of the present invention will become apparent to those skilled in the art to which this invention pertains and after a study of the present disclosure of the invention.

DESCRIPTION OF THE PREFERRED EMBODIMENTS

Figure 1:
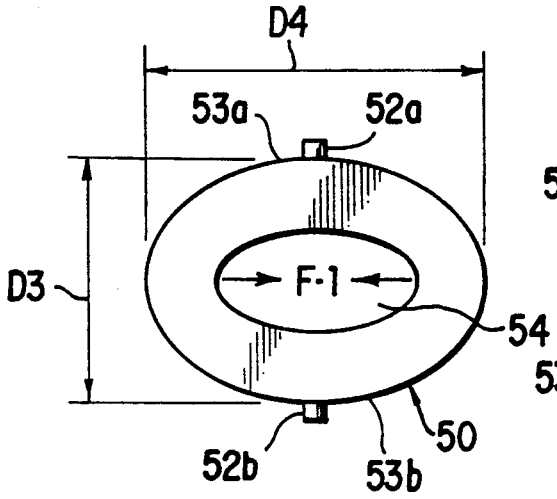
FIG. 1 is a bottom view of the deformable component of the fastening device illustrating the elliptically shaped outer periphery, the aperture wherein the deforming force is shown as applied along the major axis of the ellipse and the one pair of pegs at the ends of the minor axis dimension and into which the mating holes of the interengaging means of the cooperating component fits when the two components are interengaged and further showing the major and minor axes dimensions and the application of the deforming force.

The following is a description of the preferred embodiment of the invention. It is clear that there may be variations in the size and the shape of the fastening device. However, the main features of the device/apparatus is the deformation of the outer periphery of a deformable component of the device or of the cross section of an aperture through such a deformable component from being substantially oval or elliptical toward a more circular cross section. The degree of deformation will be dependent upon the intended use of the fastening device. The more the deformation the greater will be the clamping or the holding power of the device. The power of the device will also be a function of the the material characteristics from which the two basic components are made and of the number of interengaging means employed to effect the mechanical or the electrical connection. The device can be engaged and disengaged (interengaged) with the use of one hand and with access to only the socket component of the device. A simple "pinching" action will result in the disengagement of the components.

While the device and the principal ways in which the device functions will be described using the mechanical connectivity application, it should be clearly noted that electrical connections and switching of electrical circuits along with the control of fluids, including gases, are likewise applications for the use of the invention. It will be apparent from a reading of the following material that flow paths of gases and/or fluids may be controlled, turned on and turned off using the concepts and obvious variations of the embodiments of the invention which follow and are only exemplary of the many embodiments of the invention.

The application of the so-called deforming force will often be described as a mechanically applied force. The direction of the deforming force and the location of the interconnecting means will result in either connection-/engagement or disconnection/disengagement upon the application of the deforming force. Interengagement is considered as either engagement or disengagement and the application of the deforming force will result in deformation of the deformable component in such a manner as to result in interengagement, i.e., the turning off (disconnect) if it was in the "on" state or the turning "on" (connect) if it was in the "off" state. Further, the deforming force may be a force which is a consequence of the application of electrical, magnetic and/or thermal energy in sufficient magnitude to cause deformation resulting in interengagement or the making or breaking of electrical contacts. Fusing, because of the making or breaking of contact with heat or excess current flow, and control of electrical systems is thus a possible application for the invention as is the use of the device in the control of pneumatic and fluidic systems.

Where the deformable component is design to develop deforming forces and is made using "SHAPE MEMORY ALLOYS" (SMA) (as described in Shape Memory Alloys, by Darel E. Hodgson, of Shape Memory Applications, Inc., Ming H. Wu, Memry Corporation, and Robert J. Biermann, of Harrison Alloys, Inc., Metals Handbook ®, Volume 2, 10th Edition: Properties and Selection) especially binary, equiatomic intermetallic compound of Ni-Ti (nickel-titanium alloys) and copper base alloys such as ternary Cu-Zn-Al and Cu-Al-Ni the deformable component will be sensitive to and deform as a consequence of the heating of the component. Thus interengagement/switching/fusing etc. will be made a function of the temperature of the component. These application of the device of the invention will not be described in detail but the theory and the methodology will be known and recognized by the ordinarily skilled artisan to be the same as described and defined herein by the specification and the claims.

It is certainly possible and within the scope of the invention to incorporate within either or both of the basic components of the invention, the deformable component and the stud or cooperating component, electrical circuits/wiring and printed wiring as well as gas or fluid passages which are connected and disconnected or valved and switched according to the signals sent to devices of the invention incorporated with the control system and which signals cause the application of the deforming forces and the consequent action of each of the devices.

The device of the invention, while referred to as a fastening device, clearly has many applications to switching and control of systems. It is because of the unique use of the application of a deforming force to an elliptical configured deformable component and the relationship of the deformable component with a stud or cooperating component and the stresses and strains developed within the material of the deformable component due to the deforming force which permits the use of the invention as described.

In order to describe the invention most clearly and simply, the fastening device 10A and 10B (see FIGS. 8A and 10A) will be described as being a device with basically two components-a stud component 15 or 35 and a deformable component 20 or 30. The two components may be interconnected by a flexible connector which is not illustrated. Clearly where there is access only to one side of materials being clamped together or otherwise assembled or fastened, the flexible connector would not be used.

Figure 2:
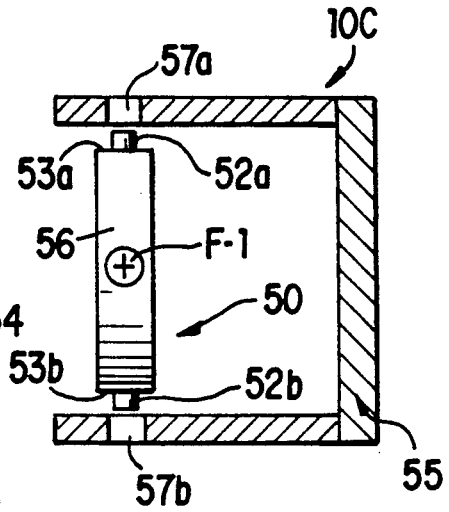
FIG. 2 is a side sectional view of the cooperating component of the fastening device and a sectional view of the deformable component illustrating the connection of the two components showing the holes of the interengaging means into which the pegs of the interengaging means fits when the two components are interengaged and also illustrating the deforming force which, when applied, causes such interengagement.
Figure 3:
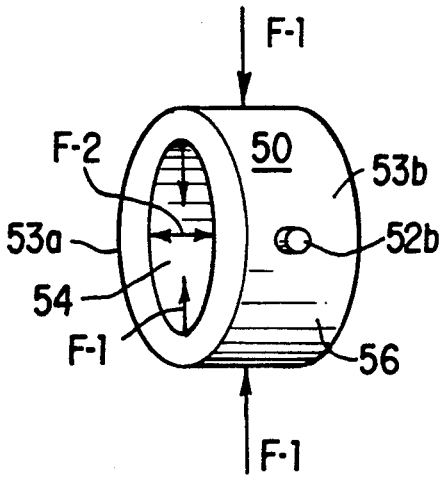
FIG. 3 is a perspective view of the deformable component of the fastening device illustrating the one pair of pegs on the outer periphery at the ends of the minor axis and illustrating the locations within the aperture and on the periphery at which the deforming force may be applied in order to effect a connection with a cooperating component having appropriately located mating holes.
Figure 3A:
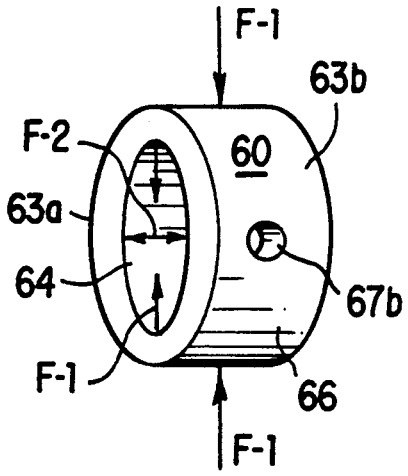
FIG. 3A. is a perspective view of the deformable component of the fastening device illustrating the one pair of holes on the outer periphery at the ends of the minor axis and illustrating the locations within the aperture and on the periphery at which the deforming force may be applied in order to effect a connection with a cooperating component having mating pegs.
Figure 4:
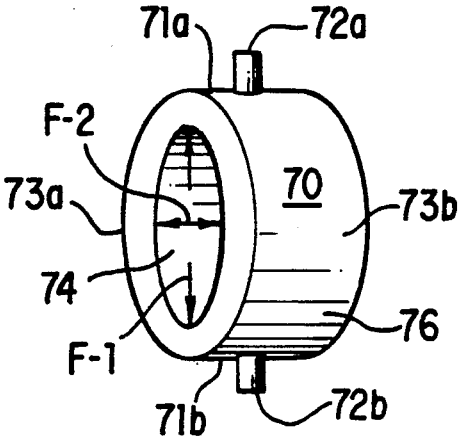
FIG. 4 is a perspective view of the deformable component of the fastening device illustrating the one pair of pegs on the outer periphery at the ends of the major axis and illustrating the locations within the aperture and on the periphery at which the deforming force may be applied in order to effect a disconnection with a cooperating component having appropriately located mating holes.
Figure 4A:
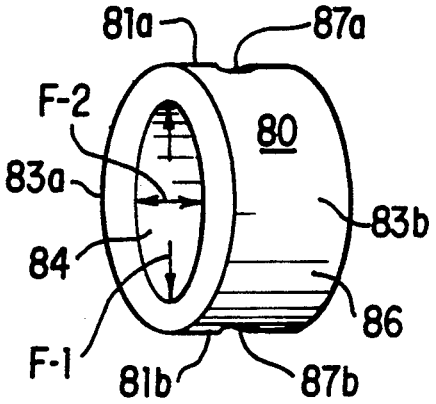
FIG. 4A. is a perspective view of the deformable component of the fastening device illustrating the one pair of holes on the outer periphery at the ends of the minor axis and illustrating the locations within the aperture and on the periphery at which the deforming force may be applied in order to effect a disconnection with a cooperating component having mating pegs.

Reference is now made to FIGS. 1–4A all of which depict an embodiment of the fastening device 10C of the invention which embodiment has the interengaging means, a pair of pegs 52*a* and 52*b* or as is shown in FIGS. 3A and 4A, a pair of holes 67*a*, 67*b* and 87*a*, 87*b* which interengaging means also comprises mating holes 57*a* and 57*b* of cooperating component 55 shown in FIG. 2. In FIG. 2 the cooperating component 55 is depicted in cross section and in a generic manner since the variations of component 55 are so great. It is only important that the means for interengaging, holes 57*a* and 57*b* in order to interengage with deformable component 50, be appropriately a part of component 55 so that interengagement takes place as a result of the application of deformation force F-1 in a direction along major axis D4. It is also important to note that aperture 54, 64, 74 or 84 need not be elliptical in shape when means for interengaging pegs 52*a*, 52*b* or 72*a*, 72*b* or pair of holes 67*a*, 67*b* and 87*a*, 87*b* are located on the elliptical shaped outer periphery 56 or 66 or 86 at the ends 53*a*, 53*b* or 63*a*, 63*b* of minor axis D3 or at the ends 71*a*, 71*b* or 81*a*, 81*b* of major axis D4. Deforming forces F-1 are illustrated in FIGS. 3 and 3A as being applied on the outer periphery 56 and 66 in line with major axis D4. F-1 may also alternately or additionally be applied within aperture 54, 64, 74 or 84. Also F-2 is an alternate or additional deforming force which again is applied in a manner which will result in interengagement (engagement if the components are disengaged or disengagement if they are engaged) upon application of the deforming force F which may be made up of forces F-1 and/or F-2.

Figure 5:
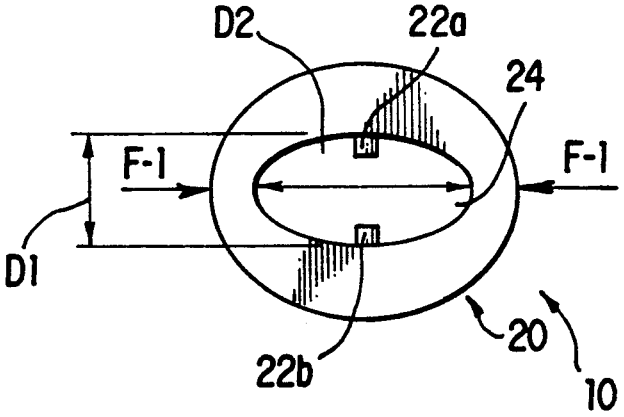
FIG. 5 is a bottom view of the deformable component of the fastening device illustrating the cross section of the aperture and the pegs into which the mating holes of the interengaging means fits when the two components are interengaged and further showing the major and minor axes dimensions and the application of the deforming force.
Figure 6:
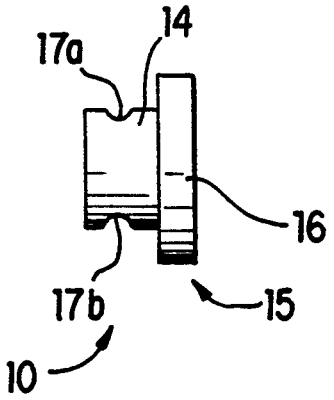
FIG. 6 is a side view of the stud component of the fastening device illustrating the substantially circular body portion of the stud component, the stud member, and the stud interengaging means comprised of a pair of mating holes.

FIGS. 5–10A illustrate the embodiment of the invention where the interengaging means which are associated with deformable component 20, 30 and 40 are located on the interior of aperture 24 and in line with the minor axis of the ellipse which defines aperture 24. FIGS. 5 and 6 illustrate the device 10 which is made up of deformable component 20 and stud component 15. Application of deforming force F-1 permits stud component 15 to be inserted into aperture 24 and upon release of F-1 pegs 22*a* and 22*b* engage with holes 17*a* and 17*b* on stud member 14. Stud component 15 is shown having a body portion 16 which is used to handle component 15. Clearly body portion 16 is not an essential component as far as the operation and use of the device 10, 10A or 10B is concerned.

Figure 7:
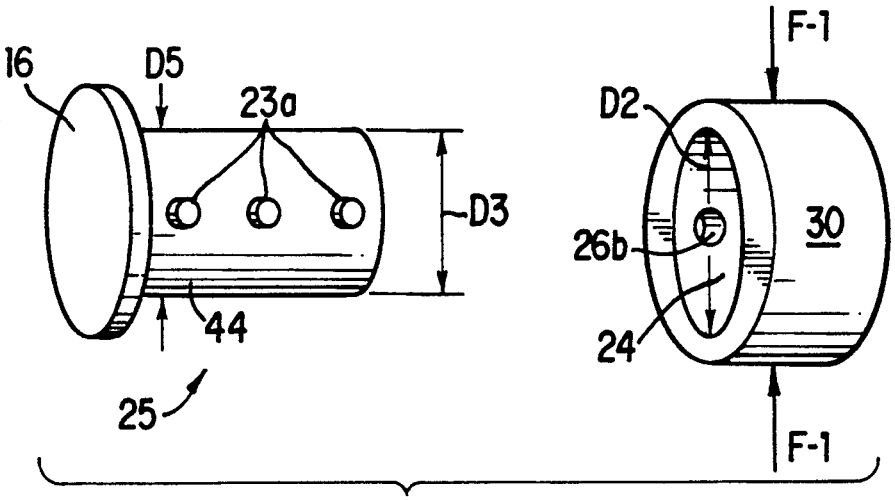
FIG. 7 is a perspective view of the fastening device illustrating the stud component having a plurality of pairs of peg interengaging means and the socket component with one pair of mating holes within the elliptical aperture.
Figure 8:
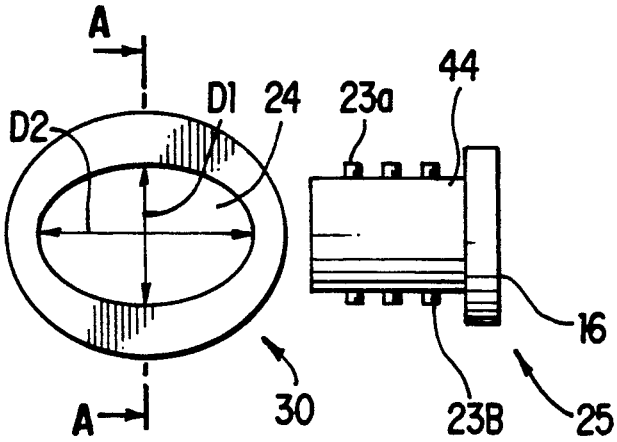
FIG. 8 is a bottom view of the deformable component and a side view of the stud component having more than one pair of pegs for engaging the one pair of mating holes of the deformable component and further showing the major and minor axes dimensions.
Figure 8A:
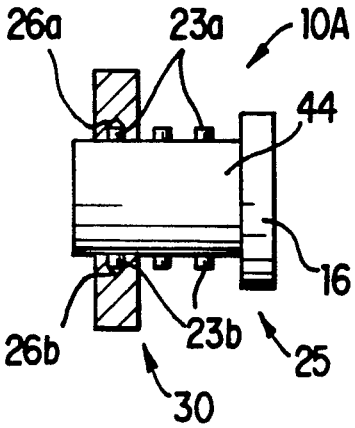
FIG. 8A is a side view of the stud component of the fastening device and a sectional view of the deformable component illustrating the connection of the two components showing the holes of the interengaging means into which the pegs of the interengaging means fits when the two components are interengaged.
Figure 9:
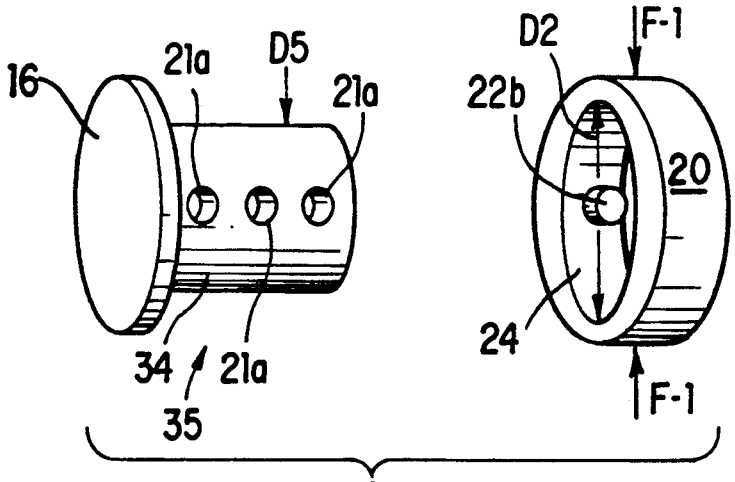
FIG. 9 is a perspective view of the fastening device illustrating the stud component having a plurality of pairs of mating holes interengaging means and the deformable component with one pair of pegs within the elliptical aperture.

FIGS. 7, 8 and 8A illustrate interengaging means comprising three pairs of pegs 23*a*, 23*b* or three pair of holes 21*a*, 21*b* being located on stud member 44 or 34. Mating holes 26*a* and 26*b* interengage with one pair of pegs 23*a* and 23*b*. Or in FIG. 9, one pair of holes 21*a* and 21*b* interengage with mating pegs 22*a* and 22*b* which are on the minor axis D1 within aperture 24 of deformable component 20. Diameter D5 of stud member 34 of stud component 35 (and also 44 of stud component 25) is of an appropriate dimension so that pegs 22*a* and 22*b* are securely and forcefully contained with one pair of holes 21*a* and 21*b*.

Figure 10:
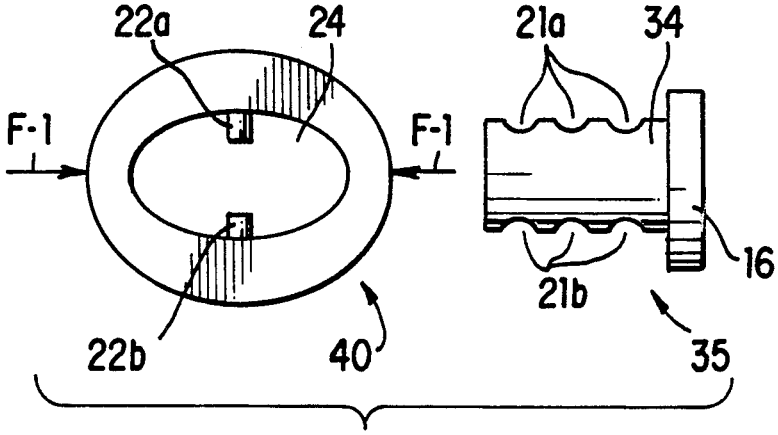
FIG. 10 is a bottom view of the deformable component and a side view of the stud component having more than one pair of mating holes for engaging the deformable component and more than one pair of pegs in the aperture of the deformable component and further showing the major and minor axes dimensions.
Figure 10A:
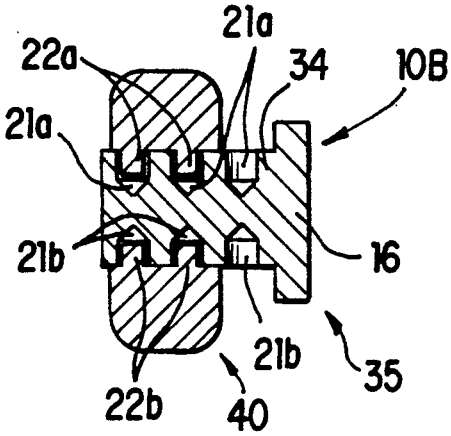
FIG. 10A is a side sectional view of the stud component of the fastening device and a sectional view of the deformable component illustrating the connection of the two components showing the two pairs of holes into which the two pair of pegs interengaging means fits when the two components are interengaged.

FIGS. 10 and 10A illustrate device 10B comprising deformable component 40 and stud component 35. Deformable component 40 is shown having two pairs of pegs 22*a* and 22*b* within aperture 24 and at the ends of minor axis D1. The spacing between the pairs of pegs 22*a* and 22*b* corresponds to the spacing of adjacent pairs of holes 21*a* and 21*b* so that they will mate for interengagement when deformable component 40 is deformed by force F-1 allowing stud member 34 to fit into aperture 24 and upon release of force F-1 interengagement takes place.

A very important advantage of the device shown by embodiments 10, 10A, 10B and 10C is that, for engaging and for disengaging of the two components, a person need have access to only one component—the deformable component 20, 30, 40, 50, 60, 70 and 80. Thus items or objects may be attached to a wall in which stud components 15, 25 or 35 are incorporated by simply clamping the objects or items using deformable components 20. The objects may be easily removed by appropriately pinching the deformable component thereby releasing the interengaging means and freeing the object. The various embodiments of the device can also be used for purposes similar to the purpose of paper clips except that the device can also be used for purposes similar to the purpose of paper clips except that the device may be used anywhere, i.e., it is not restricted in used to the periphery of the items or sheets of paper being attached together.

The instant device 10 could also be used to attach two objects when the stud component 15 is attached to one object and the deformable component 20 or 40 is attached to the second object, for example the snap closure for a garment and the like.

It is apparent that there are many additional variations. There could be additional pegs and/or additional holes in the case where additional or increased holding strength is desired. The spacing between the adjacent pairs of pegs and holes could be different so long as they remain in mating cooperation.

It is thought that the present invention, the method and the fastening device as disclosed herein and many of its attendant advantages is understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A fastening device comprising:

a stud component;

a deformable component having a dimensionally deformable substantially elliptical shaped aperture therein said deformable component aperture having a major axis dimension and a minor axis dimension, said major axis dimension being greater than said minor axis dimension, said aperture adapted to receive into interengaging position said stud component when said stud component is inserted into said aperture of said deformable component and when said deformable component is placed onto said stud component;

means for deforming said aperture thereby creating a deforming force along a direction parallel to said major axis and perpendicular to said minor axis of said elliptical shaped aperture, said aperture axes dimensions deformable so that said minor axis dimension increases as said major axis dimension decreases upon inserting and extracting of said stud component into and from said aperture of said deformable component and upon application of said deforming force to said deformable component;

said stud component comprising a substantially cylindrical shaped stud member, said aperture to receive said stud component when said stud member is inserted into said aperture of said deformable component and when said deformable component is placed onto said stud component thereby putting said deformable component and said stud component into interengaging relationship;

at least one means for interengaging said deformable and said stud components, said at least one means for interengaging matingly positioned and located on an interior wall of said aperture which surface defines said aperture of said deformable component said means for engaging lie parallel to and in line with a minor axis of said elliptically shaped aperture of said deformable component said interengaging means also being integral with said stud member and adapted to matingly cooperate with said deformable component to interengage said stud and said deformable components;

interengagement forces created by said deformation of said aperture and said interengagement of said deformable component with said stud component being only at both ends of said minor axis when said stud component is in interengagement with said deformable component;

wherein said at least one pair of interengaging means comprises:

at least one pair of mating holes disposed on opposite ends of radii of said stud member, integral with and distributed along said stud member between said body portion and protruding end of said stud member and spacing between adjacent pairs or holes being not less than a dimension which is adequate to permit said interengaging of said stud and said deformable component;

said deformable component adapted to have at least one pair of pegs for engagement which matingly cooperates with at least one pair of said at least one pair of mating holes of said stud component when said stud component and said deformable component are attached as a consequence of application of said deforming force, said stud component and deformable component interengagement results from said interengagement forces created by said deformation of said aperture.

2. The fastening device according to claim 1 wherein said deformable component is fabricated using material which is resilient but form retaining and said interengagement forces created by said deformation of said aperture are further created by said resilience of said material.

3. The fastening device according to claim 2 wherein said means for deforming said aperture comprises an appropriate mechanical deforming force resulting from the application of sufficient magnetic energy to cause said aperture deformation allowing said engagement and disengagement of said deformable component and said stud component.

4. The fastening device according to claim 1 wherein said means for deforming said aperture comprises an appropriate mechanical deforming force resulting from the application of sufficient magnetic energy to cause said aperture deformation allowing said engagement and disengagement of said deformable component and said stud component.

5. The fastening device according to claim 4 wherein said at least one pair of interengaging means comprises:

at least one pair of pegs disposed on opposite ends of radii of said stud member, integral with and distributed along said stud member between said body portion and protruding end of said stud member and spacing between adjacent pairs or holes being not less than a dimension which is adequate to permit said interengaging of said stud and said deformable component;

said deformable component adapted to have mating holes for engagement which matingly cooperates with at least one pair of said at least one pair of pegs of said stud component when said stud component and said deformable component are attached as a consequence of application of said deforming force, said stud component and deformable component interengagement results from said interengagement forces created by said deformation of said aperture and said resilience of said material.

6. The fastening device according to claim 1 wherein said deformable component is fabricated using shape memory alloys selected from the group consisting of nickel-titanium alloys and copper-base alloys Cu-Zn-Al and Cu-Al-Ni and said means for deforming said aperture comprises an appropriate means for application of sufficient thermal energy to said deformable component thus creating said deforming force sufficient in magnitude to cause said aperture deformation allowing said engagement and disengagement of said deformable component and said stud component.

7. The fastening device according to claim 6 wherein said at least one pair of interengaging means comprises:

at least one pair of pegs disposed on opposite ends of radii of said stud member, integral with and distributed along said stud member between said body portion and protruding end of said stud member and spacing between adjacent pairs or holes being not less than a dimension which is adequate to permit said interengaging of said stud and said deformable component;

said deformable component adapted to have mating holes for engagement which matingly cooperates with at least one pair of said at least one pair of pegs of said stud component when said stud component and said deformable component are attached as a consequence of application of said deforming force, said stud component and deformable component interengagement results from said interengagement forces created by said deformation of said aperture.

8. The fastening device according to claim 1 wherein said deformable component is fabricated using shape memory alloys selected from the group consisting of nickel-titanium alloys and copper-base alloys Cu-Zn-Al and Cu-Al-Ni and said means for deforming said aperture comprises an appropriate means for application of sufficient thermal energy to said deformable component thus creating said deforming force sufficient in magnitude to cause said aperture deformation allowing said engagement and disengagement of said deformable component and said stud component.

9. The fastening device according to claim 1 wherein said at least one pair of interengaging means comprises:

at least one pair of pegs disposed on opposite ends of radii of said stud member, integral with and distributed along said stud member between said body portion and protruding end of said stud member and spacing between adjacent pairs or holes being not less than a dimension which is adequate to permit said interengaging of said stud and said deformable component;

said deformable component adapted to have mating holes for engagement which matingly cooperates with at least one pair of said at least one pair of pegs of said stud component when said stud component and said deformable component are attached as a consequence of application of said deforming force, said stud component and deformable component interengagement results from said 10. A fastening device comprising:

a cooperating component;

a deformable component having a dimensionally deformable, substantially elliptical shaped outer periphery and an aperture therethrough said deformable component having a major axis dimension and a minor axis dimension, said major axis dimension being greater than said minor axis dimension, said deformable component adapted to receive into interengaging position, at said outer periphery of said deformable component, said cooperating component when said cooperating component and said deformable component are in an interengaging relationship;

means for deforming said elliptical shaped outer periphery thereby creating a deforming force along a direction parallel to said major axis and perpendicular to said minor axis, said axes dimensions deformable so that said minor axis dimension increases as said major axis dimension decreases upon application of said deforming force to said deformable component;

at least one means for interengaging said deformable and said cooperating components, said at least one means for interengaging matingly positioned and located on an outer peripheral surface of said deformable component said means for interengaging lie parallel to and in line with a minor axis of said elliptically shaped outer periphery of said deformable component, said interengaging means also being integral with said cooperating member and adapted to matingly cooperate with said deformable component to interengage said cooperating and said deformable components; and interengagement forces created by said deformation of said deformable component and said interengagement of said deformable component with said cooperating component being only at at least one end of said minor axis when said cooperating component is in interengagement with said deformable component.

11. The fastening device according to claim 10 wherein said deformable component is fabricated using material which is resilient but form retaining and said interengagement forces created by said deformation of said deformable component are further created by said resilience of said material.

12. The fastening device according to claim 11 wherein said at least one pair of interengaging means comprises:

at least one pair of mating holes disposed on said cooperating member to permit said interengaging of said cooperating and said deformable component;

said deformable component adapted to have at least one pair of pegs for engagement which matingly cooperates with at least one pair of said at least one pair of mating holes of said cooperating component when said cooperating component and said deformable component are attached as a consequence of application of said deforming force, said cooperating component and deformable component interengagement results from said interengagement forces created by said deformation of said deformable component and said resilience of said material.

13. The fastening device according to claim 11 wherein said means for deforming said aperture comprises an appropriate mechanical deforming force resulting from the application of sufficient magnetic energy to cause said deformation of said deformable component allowing said engagement and disengagement of said deformable component and said cooperating component.

14. The fastening device according to claim 13 wherein said at least one pair of interengaging means comprises:

at least one pair of pegs disposed on said cooperating member to permit said interengaging of said cooperating and said deformable component;

said deformable component adapted to have mating holes for engagement which matingly cooperates with at least one pair of said at least one pair of pegs of said cooperating component when said cooperating component and said deformable component are attached as a consequence of application of said deforming force, said cooperating component and deformable component interengagement results from said interengagement forces created by said deformation of said deformable component and said resilience of said material.

15. The fastening device according to claim 10 wherein said at least one pair of interengaging means comprise:

at least one pair of mating holes disposed on said cooperating member to permit said interengaging of said cooperating and said deformable component;

said deformable component adapted to have at least one pair of pegs for engagement which matingly cooperates with at least one pair of said at least one pair of mating holes of said cooperating component when said cooperating component and said deformable component are attached as a consequence of application of said deforming force, said cooperating component and deformable component interengagement results from said interengagement forces created by said deformation of said deformable component.

16. The fastening device according to claim 15 wherein said means for deforming said aperture comprises an appropriate mechanical deforming force resulting from the application of sufficient magnetic energy to cause said deformation of said deformable component allowing said engagement and disengagement of said deformable component and said cooperating component.

17. The fastening device according to claim 15 wherein said deformable component is fabricated using shape memory alloys selected from the group consisting of nickel-titanium alloys and copper-base alloys Cu-Zn-Al and Cu-Al-Ni and said means for deforming said periphery comprises an appropriate means for application of sufficient thermal energy to said deformable component thus creating said deforming force sufficient in magnitude to cause said periphery deformation allowing said engagement and disengagement of said deformable component and said cooperating component.

18. The fastening device according to claim 10 wherein said deformable component is fabricated using shape memory alloys selected from the group consisting of nickel-titanium alloys and copper-base alloys Cu-Zn-Al and Cu-Al-Ni and said means for deforming said periphery comprises an appropriate means for application of sufficient thermal energy to said deformable component thus creating said deforming force sufficient in magnitude to cause said periphery deformation allowing said engagement and disengagement of said deformable component and said cooperating component.

19. The fastening device according to claim 18 wherein said at least one pair of interengaging means comprises:

at least one pair of pegs disposed on said cooperating member to permit said interengaging of said cooperating and said deformable component;

said deformable component adapted to have mating holes for engagement which matingly cooperates with at least one pair of said at least one pair of pegs of said cooperating component when said cooperating component and said deformable component are attached as a consequence of application of said deforming force, said cooperating component and deformable component interengagement results from said interengagement forces created by said deformation of said deformable component.

20. The fastening device according to claim 10 wherein said at least one pair of interengaging means comprises:

at least one pair of pegs disposed on said cooperating member to permit said interengaging of said cooperating and said deformable component;

said deformable component adapted to have mating holes for engagement which matingly cooperates with at least one pair of said at least one pair of pegs of said cooperating component when said cooperating component and said deformable component are attached as a consequence of application of said deforming force, said cooperating component and deformable component interengagement results from said interengagement forces created by said deformation of said deformable component.

* * * * *